United States Patent [19]

Boccadoro et al.

[11] Patent Number: 4,558,672

[45] Date of Patent: Dec. 17, 1985

[54] PROCESS FOR SHUTOFF OF FUEL INJECTION DURING THE DECELERATION PHASES OF AN INTERNAL COMBUSTION ENGINE

[75] Inventors: Yves Boccadoro, Feucherolles; Bernard Lepretre, Boulogne Billancourt, both of France

[73] Assignee: Regie Nationale des Usines Renault, Boulogne Billancourt, France

[21] Appl. No.: 609,863

[22] Filed: May 14, 1984

[30] Foreign Application Priority Data

May 13, 1983 [FR] France ..... 83 07971

[51] Int. Cl.[4] ..... F02D 5/00

[52] U.S. Cl. ..... 123/325; 123/326; 123/493

[58] Field of Search ..... 123/493, 325, 326

[56] References Cited

U.S. PATENT DOCUMENTS

| | | | |
|---|---|---|---|
| 4,327,682 | 5/1982 | Harada | 123/493 |
| 4,414,941 | 11/1983 | Nakanishi | 123/325 |
| 4,416,240 | 11/1983 | Matsuoka | 123/493 |

*Primary Examiner*—Andrew M. Dolinar

*Attorney, Agent, or Firm*—Oblon, Fisher, Spivak, McClelland & Maier

[57] ABSTRACT

A process whereby fuel injection is interrupted in response to detection of a deceleration and injection is again ordered when a threshold linked to the engine speed is reached. The engine speed (N) or period of rotation (T) is measured from consecutive equal intervals or angles of rotation. A difference (ΔT, ΔN) is then computed between the value of the last measured speed or period and the value seen through a high-pass filter of the speed or period measured at the preceding interval. This difference (ΔT, ΔN) is compared with a fixed threshold (S) and if an engine deceleration condition is detected, fuel injection is again ordered when the difference (ΔT, ΔN) is greater than the threshold (S).

4 Claims, 3 Drawing Figures

PROCESS FOR SHUTOFF OF FUEL INJECTION DURING THE DECELERATION PHASES OF AN INTERNAL COMBUSTION ENGINE

BACKGROUND OF THE INVENTION

1. Field of the Invention

This invention relates to a process for shutoff of fuel injection during the deceleration phases of an internal combustion engine.

2. Description of the Prior Art

With electronic fuel injection systems, whether they be monopoint or multipoint, it is possible to improve average engine consumption by shutting off fuel injection during sharp deceleration phases.

This fuel injection shutoff can be triggered in response to closing of an electric switch indicating the closed position of the throttle controlling the engine air flow, detection of a threshold of the pressure prevailing in the intake manifold, detection of a predetermined limiting injection time or the like.

The fuel saving realized will be greater, the longer the injection is shutoff. Therefore, it is desirable to restart the injection system, i.e., to inject fuel again, at an engine speed that is as low as possible.

This restart is not accomplished without difficulty because it has been found that the speed drop of a no-load engine is much greater when it is not being fed fuel. Therefore, the procedure of shutoff in deceleration results in a high risk of engine stall when injection is restarted, because of what hereafter will be called the "restart speed or threshold," being too low. This phenomenon is notable after a no-load acceleration (particularly in the presence of turned power steering) or when the driver disengages the clutch after a long deceleration under load.

Although the difficulty can be encountered in multipoint injection systems (one injector per cylinder), it is greatly amplified with a monopoint type injection system comprising a single injector positioned above a butterfly placed in a body similar to that of a carburetor to control the engine air flow. Actually, for the latter there is a considerable lag between the order to resume injection and the moment when the cylinder has received sufficient fuel to assure a correct combustion.

Patent No. GB-A-2,062,295 attempts to solve to this problem by means of a process by which fuel injection is interrupted in response to detection of a deceleration, the period of rotation of the engine is measured from consecutive equal intervals or angles of rotation and the difference between the period measured from the last interval and the period measured from the preceding interval is calculated. This difference is compared with a fixed threshold to determine if the engine is in a state of slow or fast deceleration and again the fuel injection is ordered at one or other of the two fixed thresholds of engine speed depending on whether it is in slow or fast deceleration.

However, this process is not reliable because of the existence of rapid variations of the instantaneous period of the engine which are often fleeting and of a mechanical origin, such as play in the transmissions, engine suspension problems, or any other phenomenon causing instantaneous, short variations in speed. Erroneous detections of slow or fast deceleration conditions can result and be reflected either in a premature "restart" if a fast deceleration is detected in error or, on the contrary, in stalling of the engine in the opposite case. Further, the use of two fixed "restart" thresholds instead of a single one is a compromise solution that does not totally eliminate the risks of engine stalls and does not make it possible to optimize the fuel injection shutoff process in deceleration.

SUMMARY OF THE INVENTION

Accordingly, it is an object of the present invention to eliminate the aforementioned drawbacks by a process of shutting off the fuel injection for an internal combustion engine with electronic fuel injection which assures a satisfactory smooth running engine, while making it possible to maximize the gains in fuel savings as a result of an anticipation of the restart phenomenon when there is a risk of engine stall.

For this purpose, the invention has as its object a process for shutting off fuel injection in the deceleration phases of an internal combustion engine, in which the fuel injection is interrupted in response to the detection of a deceleration and injection is ordered again when a threshold linked to the engine speed is reached, characterized in that the engine speed (N) or period of rotation (T) is measured from consecutive equal intervals or angles of rotation, with the difference ($\Delta N$, $\Delta T$) in speed or period of rotation being computed between the speed or period ($N_n$, $T_n$) measured from the last angular interval and the value ($\overline{N}_n$, $\overline{T}_n$) seen through a high-pass filter of the speed or period ($N_{n-1'}$, $T_{n-1}$) measured from the preceding angular interval. This difference ($\Delta N$, $\Delta T$) is compared with a fixed threshold (S) and, if an engine deceleration condition is detected, fuel injection is again ordered when the difference ($\Delta N$, $\Delta T$) is greater than the threshold (S).

BRIEF DESCRIPTION OF THE DRAWINGS

Other characteristics and advantages of the invention will come out from the following description of an example of use by the accompanying drawings in which.

DETAILED DESCRIPTION OF THE PREFERRED EMBODIMENT

Figure 1:
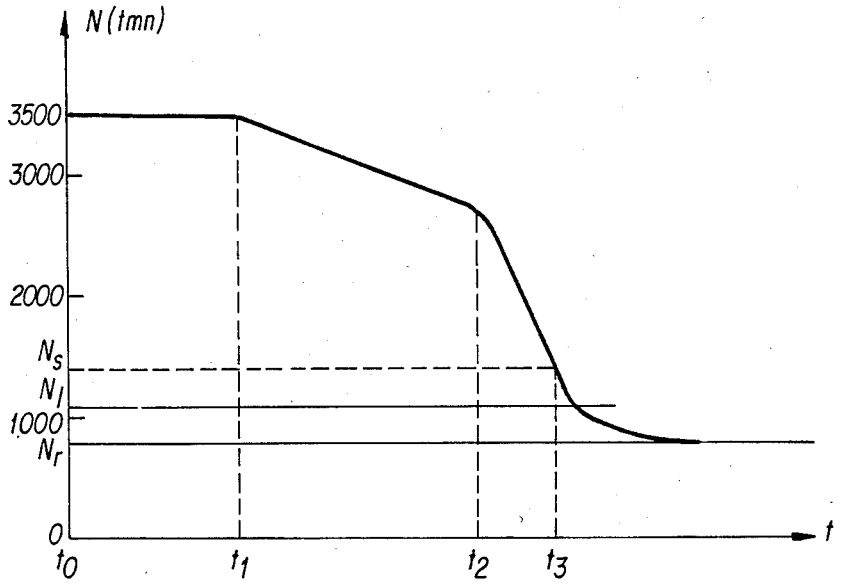
FIG. 1 is a graph showing the variation of the speed of a gasoline injection engine as a function of time in case of a deceleration under load followed by a no-load deceleration.

The graph of FIG. 1 shows an example of evolution of the speed N (rpm) of an internal combustion engine with gasoline injection and spark ignition of a motor vehicle. Between instants $t_0$ and $t_1$ the engine speed is constant and, starting from instant $t_1$, a deceleration under load occurs as a result of the driver of the vehicle lifting his foot from the accelerator. Instant $t_2$, shows the disengaging of the clutch and it is seen that deceleration of the engine is then much more pronounced than between instants $t_1$ and $t_2$.

Injection of gasoline having been shut off at instant $t_1$ when the foot is lifted from the accelerator, this injection is restarted at instant $t_3$ a speed $N_S$ called the "restart threshold,". Because the accelerator is assumed to be still released, i.e., the throttle closed, the engine speed then decreases progressively to the engine idling speed $N_R$.

This graph of FIG. 1 shows that the restart threshold $N_S$ should be both high enough to avoid stalling of the engine during sharp no-load decelerations, and low enough, to maximize the consumption gains during slighter decelerations under load where the risk of stalling is not as high.

This leads to adopting a restart threshold $N_S$ that is variable as a function of the instantaneous running conditions of the engine. A solution would consist in comparing the derivative of the engine speed or period, computed from an interval of angular rotation, with the threshold itself as a function of the speed. However, this solution is relatively complex and unwieldy to use.

To solve this problem, the invention constantly compares, when a deceleration conditioning has been detected and fuel injection shut off, a fixed threshold S with the difference between the speed or period of rotation of the engine measured from the last angular interval and the speed or period measured at the preceding angular interval seen through a high-pass filter, and in again ordering fuel injection when the difference is greater than threshold S. The angular interval selected will preferably be equal to that which separates the passage of the pistons through the top dead center, i.e., a half revolution in the case of a four cylinder engine.

Figure 2:
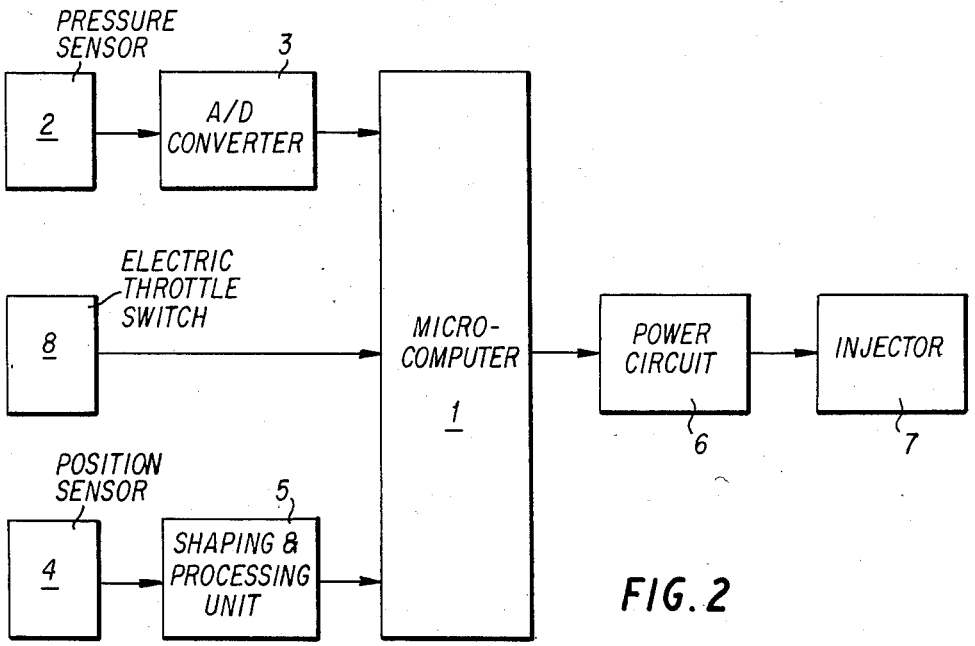
FIG. 2 is a block diagram of a monopoint injection system for using the process of injection shutoff according to the invention.

FIG. 2 describes a monopoint injection system for using the process according to the invention. A similar injection system is described in more detail in French patent application No. 82-13996, it being understood that the invention is not limited to that system.

Briefly, the monopoint injection system shown comprises a programmed microcomputer 1 such as, for example, the microprocessor 6801, which receives at an input the value of the pressure in the intake manifold of an engine supplied by a pressure sensor 2 and converted into digital form by an analog-digital converter 3. A position sensor 4, detecting the passage of the teeth which are provided on the periphery of a target fastened on the engine crankshaft and rotating synchronously with it, delivers a signal that is shaped and processed in a unit 5. Unit 5 produces a synchronization signal $S_Y$ identifying the passage of each cylinder through the top dead center and aiding microcomputer 1 in computing the engine speed. Acquisition and computation of these "pressure" and "speed" parameters and a cartography that it has in storage enable microcomputer 1 to compute the "calculated $t_1$ injection time according to a suitable algorithm. Thanks to the synchronization signal $S_Y$ and its internal timer, microcomputer 1 orders, in the vicinity of the top dead center, the opening of an injector 7 by a power circuit 6.

Further, computer 1 is connected by one of its inputs to an electric butterfly switch 8 which is closed when the engine throttle is in closed position, i.e., when the driver has lifted his foot from the accelerator.

Figure 3:
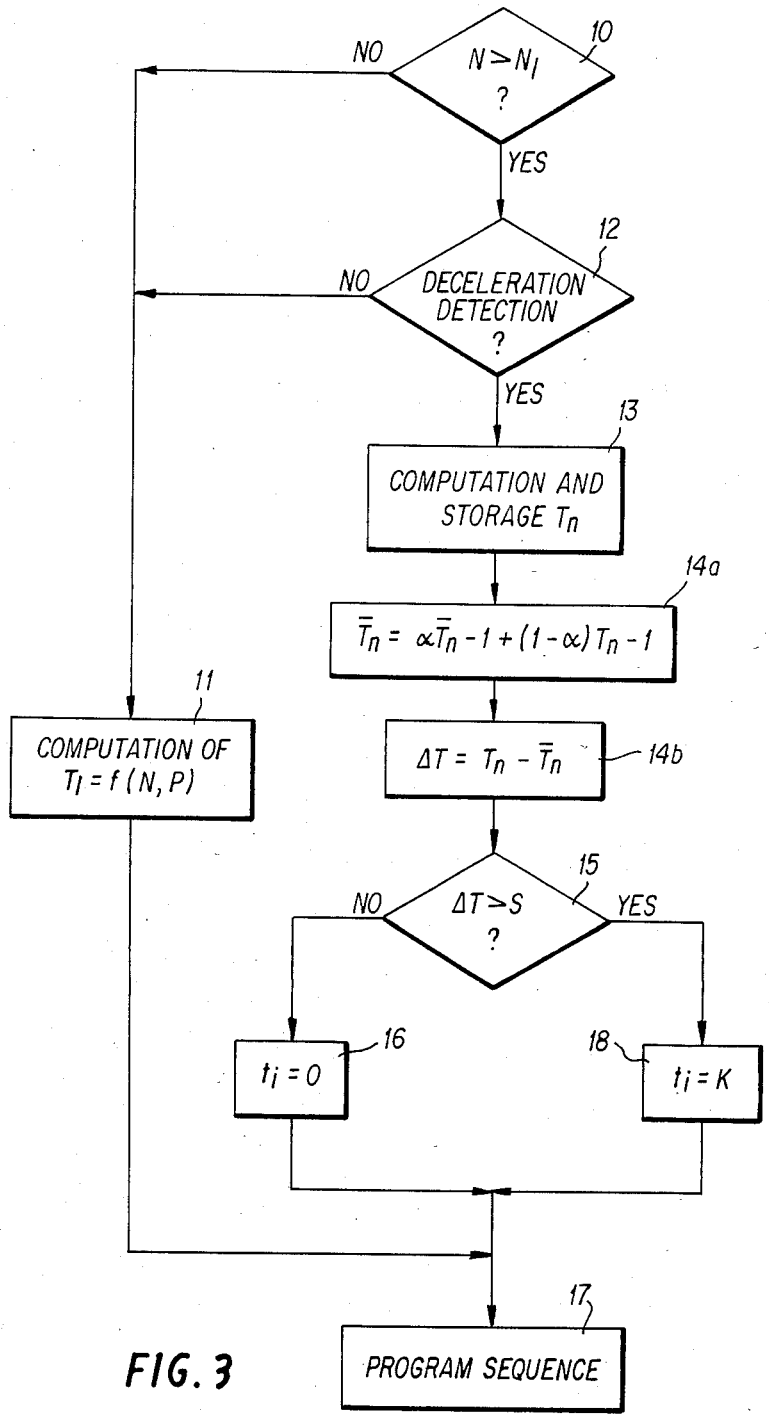
FIG. 3 is an algorithm illustrating the process according to the invention.

Reference is now made to FIG. 3 which shows an algorithm that can be put in the main program of injection computer 1 to use the injection shutoff process. This program and the shutoff algorithm operate with a periodicity as a function of the number of cylinders of the engine, i.e., at each half revolution in the case of a four cylinder engine, which will be assumed to be the case below.

First stage 10 is a test of engine speed N which is compared with a limiting speed $N_1$. Actually, the injection is never shut off if the rotation speed is less than this limiting speed $N_1$, for example 1100 rpm; in this case, injection time $t_1$ is then computed by a standard subprogram 11 as a function, particularly, of the speed and pressure, as indicated above.

If speed N is greater than limiting speed $N_1$, a test is made at 12 to determine if the engine is or is not in deceleration. The response to this test is given by the state of switch 8 (open or closed) or by any other suitable means.

If a deceleration is not detected, one goes on to subprogram 11 and, in the contrary case, time $T_n$, sent by the engine to make the last half revolution (stage 13) is computed and stored.

The following two stages **14*a* and 14*b* consist in performing computations to compare with threshold S in step 15** the difference between the period measured from the last angular interval and the period measured from the preceding angular interval after passing through a high-pass filter, which makes it possible to get away from the spurious speed problems in a simple way. Considered as the Laplace transform, this comparison is in the form:

$$\frac{\tau P}{1+\tau P}\cdot T > S,$$

an expression in which:

P is the Laplacian operator $\tau$ is a filtering time constant of predetermined value.

Stage **14*a*** consists in computing the value $T_n$ seen through a high-pass filter of the period measured from the preceding angular interval and expressed by the relation:

$$\overline{T}_n=\alpha\overline{T}_{n-1}+(1-\alpha)T_{n-1} \quad (1)$$

in which:

$T_{n-1}$ is the period measured at the preceding angular interval;

$\overline{T}_{n-1}$ is the value of the period seen through a high-pass filter at the preceding angular interval;

$\alpha$ is a programmable constant of predetermined value;

At stage **14*b***, said difference $\Delta T$ is computed which is such that:

$$\Delta T=T_n-\overline{T}_n$$

At stage 15, difference $\Delta T$ is compared with a fixed threshold S:

if $\Delta T$ is less than threshold S, injection shutoff ($t_i=0$ at stage 16) is maintained and one then goes to the program sequence represented in the form of unit 17;

if $\Delta T$ is greater than or equal to threshold S, fuel injection is resumed. For this first injection after a shutoff, preferably a constant injection time K (stage 18), is created, which is clearly greater, for example, by three to five times, than that which would normally be computed by the microcomputer. This injection time K is a function of the instantaneous parameters of the engine, and based upon the knowledge that the butterfly is then closed and that the restart speed $N_S$, although variable, is in practice in a certain bracket, on the order of 1300 to 1500 rpm.

It is known that, during a cold start or after a shutoff in deceleration, a part of the injected fuel has a tendency to be deposited on the walls of the intake manifold.

Injection of an amount of fuel clearly greater than that theoretically necessary to assure combustion for given engine conditions, during a first injection spray after a shutoff, makes it possible to remedy this phenomenon of wetting of the intake manifold walls.

Of course, the invention is not limited to the embodiments that have just been described, and numerous modifications can be made without thereby going outside its scope. Thus, for example, the variation of speed $\Delta N$ can be computed instead of the variation of the period $\Delta T$ from one angular interval to the next and $\Delta N$ can be compared with a fixed threshold. It is also possible to make tests 10 and 12 from limiting speed $N_1$ and detection of a deceleration after computation of period T or of speed N at the preceding interval, or after computation of $\Delta T$ or $\Delta N$. The relation (1) can therefore be expressed in the following general form:

$$X_n=\alpha\overline{X}_{n-1}+(1-\alpha)X_{n-1},$$

in which X represents either the period T or speed N.

Finally, it will be noted that the injection after a shutoff in deceleration can cause several injection sprays of a period greater than that theoretically necessary to assure combustion for given engine conditions.

We claim:

1. A process for shutoff of fuel injection in the deceleration phases of an internal combustion engine whereby fuel injection is interrupted in response to detection of a deceleration and fuel injection is restarted when a threshold linked to the engine speed is reached, comprising the steps of:

measuring the engine speed (N) or period of rotation (T) from consecutive equal intervals or angles of rotation of said engine;

computing the difference ($\Delta N$, $\Delta T$) between the speed or period ($N_n$, $T_n$) measured from the last angular interval and the value ($\overline{N}_n$, $\overline{T}_n$) fed through a high-pass filter of the speed or period ($N_{n-1}$, $T_{n-1}$) measured from the preceding angular interval;

comparing said difference ($\Delta N$, $\Delta T$) with a fixed threshold (S) in order to determine whether engine deceleration has been detected and to provide restarting of fuel injection when said difference ($\Delta N$, $\Delta T$) is greater than said threshold (S).

2. Process according to claim 1, wherein said value ($\overline{N}_n$, $\overline{T}_n$) fed through a high-pass filter of the speed or period ($N_{n-1}$, $T_{n-1}$) measured from the preceding angular interval is computed according to the relation $$\overline{X}_n=\alpha\overline{X}_{n-1}+(1-\alpha)X_{n-1}$$

in which:

$X_{n-1}$ is the speed (N) or period (T) measured at the preceding angular interval;

$\overline{X}_{n-1}$ is the value of the speed or period seen through a high-pass filter at the preceding angular interval; and $\alpha$ is a programmable constant of predetermined value.

3. The process according to any one of claims 1 or 2 further comprising the step of:

detecting said engine deceleration by means of the state of an electric throttle switch; and providing said shutoff of fuel injection when said switch is in a state representative of the closed position of said throttle and when said engine speed is greater than a predetermined limiting speed ($N_1$).

4. The process according to claim 1 comprising the further step of:

ordering, when said difference ($\Delta N$, $\Delta T$) is greater than said fixed threshold (S), a first injection spray of fixed length greater than the injection time theoretically needed to assure combustion under the instantaeous operating conditions of said engine.

* * * * *